US005769514A

United States Patent [19]

Brown et al.

[11] Patent Number: 5,769,514

[45] Date of Patent: Jun. 23, 1998

[54] READY TO USE FOLDABLE COMPUTER DESK

[75] Inventors: Charles R. Brown; Marion O. Fogle; Thomas F. Salley, all of Orangeburg, S.C.

[73] Assignee: Decolam, Inc., Orangeburg, S.C.

[21] Appl. No.: 754,887

[22] Filed: Nov. 22, 1996

[51] Int. Cl.[6] ..... A47B 19/08

[52] U.S. Cl. ..... 312/195; 312/258; 312/223.6; 108/50.01; 108/129

[58] Field of Search ..... 312/258, 194, 312/195, 239, 223.3, 223.6; 248/439, 166; 108/36, 132, 131, 129, 50.01, 50.02

[56] References Cited

U.S. PATENT DOCUMENTS

| | | | |
|---|---|---|---|
| 795,844 | 8/1905 | Marsh . | |
| 1,237,009 | 8/1917 | Yaw . | |
| 1,568,167 | 1/1926 | Kunkle . | |
| 2,542,770 | 2/1951 | Hall | 108/131 |
| 3,373,703 | 3/1968 | Barecki | 108/50.01 |
| 3,854,828 | 12/1974 | Jones . | |
| 3,865,051 | 2/1975 | Johl et al. | 108/132 |
| 4,063,330 | 12/1977 | Triplette . | |
| 4,135,273 | 1/1979 | Holmes . | |
| 4,341,164 | 7/1982 | Johnson | 108/129 X |
| 4,715,296 | 12/1987 | Wilkinson | 108/132 X |
| 4,731,029 | 3/1988 | Lerner et al. . | |
| 4,944,694 | 7/1990 | Dorn . | |
| 5,290,099 | 3/1994 | Lechman | 312/208.1 |
| 5,390,999 | 2/1995 | Fuller | 312/258 X |
| 5,403,082 | 4/1995 | Kramer | 312/249.9 |
| 5,457,600 | 10/1995 | Campbell et al. | 361/643 |
| 5,487,525 | 1/1996 | Drabczyk et al. | 108/143 X |
| 5,509,361 | 4/1996 | Chen | 108/131 X |
| 5,535,682 | 7/1996 | Aigeldinger | 108/129 X |

FOREIGN PATENT DOCUMENTS

| | | | |
|---|---|---|---|
| 277942 | 9/1930 | Italy | 108/129 |
| 270985 | 5/1927 | United Kingdom | 108/132 |

*Primary Examiner*—Jose V. Chen
*Assistant Examiner*—James O. Hansen
*Attorney, Agent, or Firm*—Cort Flint; Robert R. Reed

[57] ABSTRACT

A foldable ready to use computer desk is disclosed having a desk top for supporting computer equipment and the like and a pair of spaced foldable side members which include solid panels that form sides of the desk and support the desk above the floor. The solid side panels are carried by hinges having displaced pivot points which allow the side members to fold over one another in an overlapping manner to create a utility space between the side members and the desk top in which utility devices such as a keyboard drawer assembly, power surge strip, and cable tray are nested when the desk is folded. Brace assemblies urge the side members outwardly in an extended position to support the desk top above the floor and urge upper portions of the side members against the hinge brackets to provide a sturdy construction.

22 Claims, 9 Drawing Sheets

READY TO USE FOLDABLE COMPUTER DESK

BACKGROUND OF THE INVENTION

This invention relates to a foldable, ready to use desk, and more particularly, to a desk for computer equipment and the like which may be folded for shipment or storage and which may be readily unfolded to a sturdy, useable configuration without need of assembly or other further effort.

Heretofore, desks for computer equipment have been provided which include a desk unit, hutch unit, and/or printer unit which are shipped unassembled and must be assembled by the purchaser. The assembly of the prior computer desks has required much time and effort, and often produces frustration since the parts and their assembly are numerous. Such desks are not readily useable when purchased due to the time and effort required for assembly, nor may they be folded for storage.

Examples of various utility tables include U.S. Pat. No. 5,535,682 which discloses a utility table having a top and portable legs wherein the top has openings. The underside of the top includes flexible strips extending across the respective openings to form pockets for drink containers. The legs fold up against the underneath of the top with the flexible strips gathering between the legs and top. U.S. Pat. No. 3,854,828 discloses a table with yet another arrangement of folding legs wherein a pivot includes first and second sections having threaded bores whereby the leg is locked in position by threading an end of the leg into both bores.

Computer desks are also known in various forms and combinations such as those shown in U.S. Pat. Nos. 5,403,082 and 5,290,099, the latter patent disclosing a common slidable keyboard tray.

While the above arrangements are suitable for their applications, the provision of a ready to use computer desk which may be easily set up and taken down while accommodating the various equipment used with a computer and like equipment is a problem to which considerable attention need be given.

Accordingly, an object of the present invention is to provide a foldable, ready to use desk for computer equipment and the like which may be readily folded for shipment or storage, and may be readily unfolded to a sturdy position for use.

Another object of the present invention is to provide a foldable, ready to use computer desk having a utility space underneath a top of the desk for accommodating associated computer equipment and foldable sides of the desk which fold over the utility space, yet readily unfold to a sturdy position for use of the desk.

Yet another important object of the present invention is to provide a utility desk having a folded configuration wherein sturdy sides of the desk are folded about a displaced pivot from the desk top so as to provide a utility space between the folded sides and the underneath of the desk top in which associated equipment may be housed.

SUMMARY OF THE INVENTION

The above objectives are accomplished according to the present invention by providing a foldable ready to use computer table comprising a desk top having a support surface for supporting computer equipment. A keyboard drawer assembly for containing a computer keyboard is carried underneath the desk top with the keyboard drawer assembly having a pair of spaced support elements for supporting a slidable keyboard drawer. The spaced support elements extending away from the desk top and terminate at terminal edges a predetermined distance away from the desk top.

First and second spaced desk side members are pivotally carried by the underneath surface of the desk top. The first and second side members are solid sides that terminate in floor engaging supports for supporting the desk top above the floor. Displaced pivot hinges attach the first and second side members to the underneath surface of the desk top with each of the displaced pivot hinges having a first part attached to the desk top, a second part attached to the side members, and a displaced pivot displaced from the first part and desk top about which the first and second side members pivot. In a preferred embodiment the second pivot axis of the second displacement hinge is displaced a greater distance from the desk top than the first pivot axis of the first displacement hinge.

The first side member pivots about a first pivot axis displaced from the underneath surface between a folded position and an extended position. The first side member is generally parallel to and overlying the desk top in the folded position, and is extended away from the desk top to engage the floor to support the desk top and the computer equipment thereon in an extended position. The second side member pivots about a second pivot axis displaced from the second side member between a folded position and an extended position. The second side member is generally parallel to and overlies the first side member in a folded position and being extended away from the desk top to engage the floor to support the desk top and the computer equipment thereon in an extended position. The first and second pivot axes are displaced from the underneath surface of the desk top so that the first and second side members fold over the terminal edges of the support elements of the keyboard drawer assembly in a folded position in a compact, folded configuration for convenient storage and/or transportation. Preferably, at least one brace member is included for maintaining the first and second side members in an extended position.

The first and second pivots of the hinges are displaced a distance past the terminal edges of the keyboard assembly. A cable tray is carried underneath the desk top, and an electrical connector is carried in the cable tray for being electrically connected to the computer equipment so that the electrical cords connecting the computer equipment may be stored in the cable tray generally out of sight. A utility space is defined between the first and second side members in the folded positions and an underneath surface of the desk top with at least one utility device is carried within the utility space for use with computer equipment and the like. This includes at least the keyboard drawer assembly secured underneath the desk top and power strip and tray which are nested between the underneath of surface of the desk top and the side members and the folded positions.

Advantageously, the first and second side members include a top bracing portion which abuts a vertical leg of a respective displacement hinge in an extended position. The brace assembly urges the top bracing portions of the first and second side elements against the vertical legs in an extended position for sturdiness.

In another embodiment of the invention, a foldable support shelf is provided for supporting a computer unit. The support shelf includes a horizontal support section releasably carried by one of the side members and a vertical side section carried by the desk top. The horizontal section is pivotally attached to the vertical section by a corner hinge, and a support hinge pivotally affixes the vertical section to the desk top. The support shelf has a folded position in which said horizontal and vertical sections assume a generally parallel overlying relation between said first side member and said desk top. The shelf hinge has a pivot axis for displacing said bottom and side sections a third distance d3 from said desk top, said third distance being less than said distance d1.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
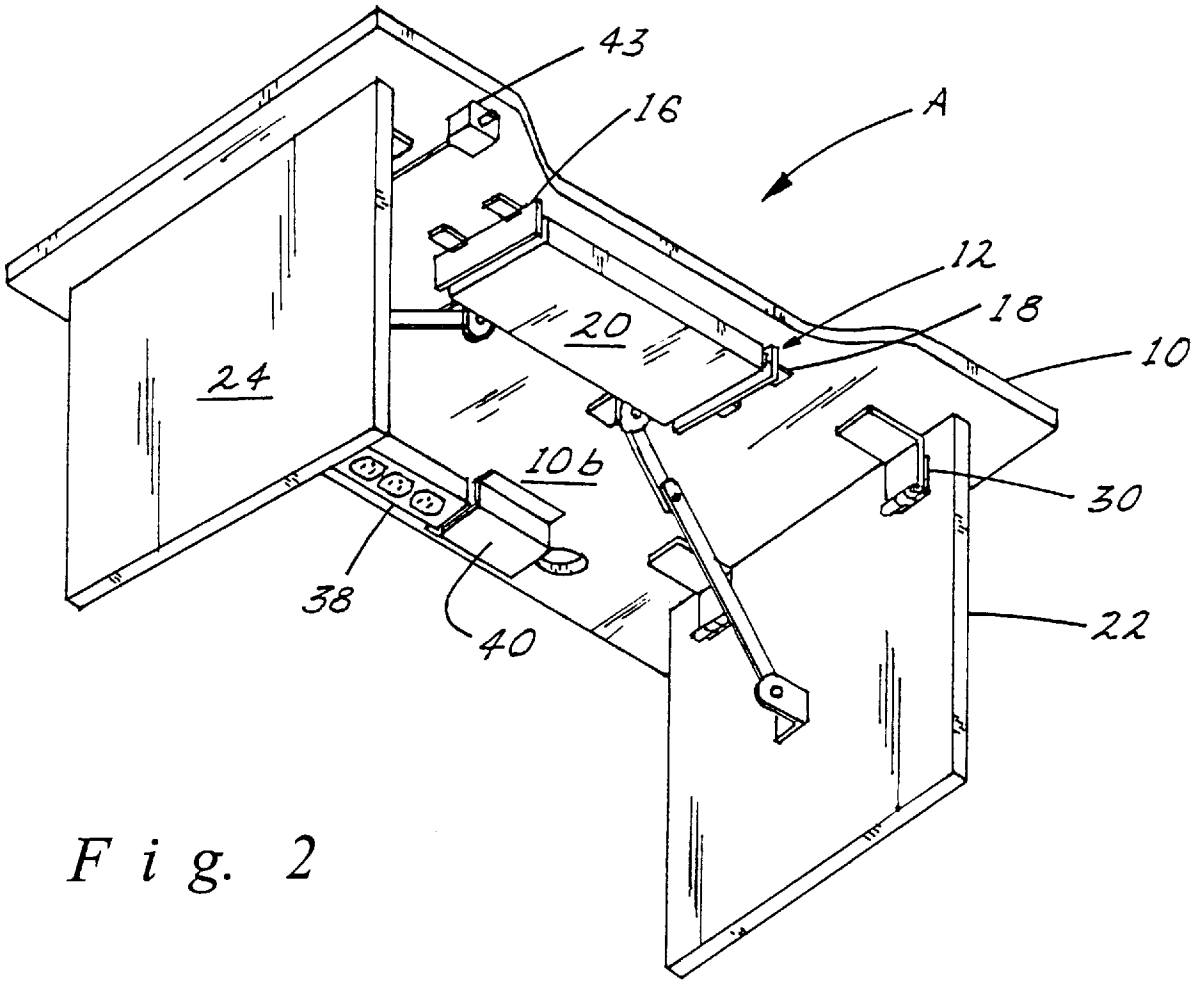
FIG. 2 is a bottom perspective view of a foldable, ready to use computer desk Instructed according to the present invention.
Figure 3:
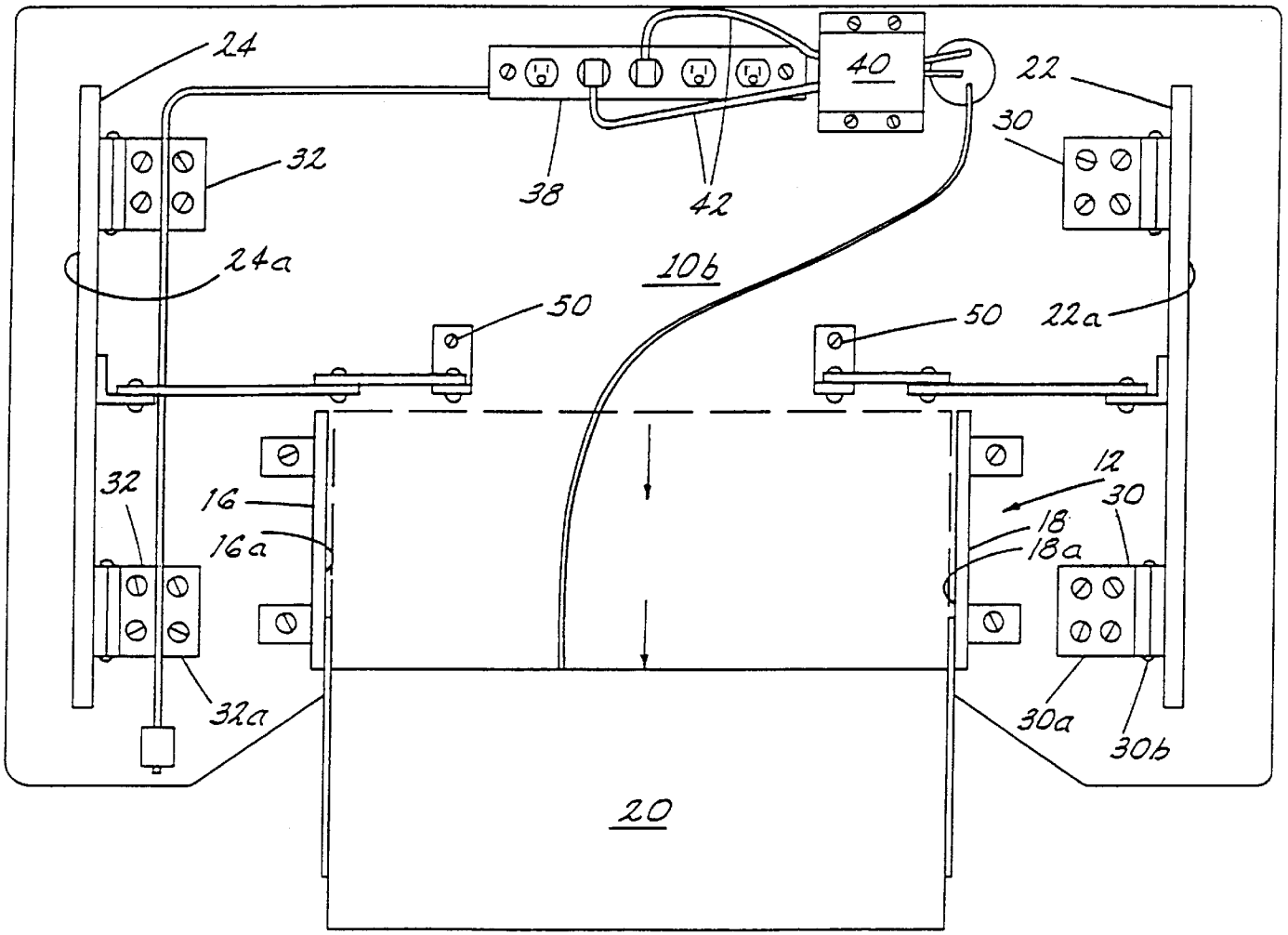
FIG. 3 is a bottom plan view illustrating the various utility and elements of a foldable, and ready to use computer desk constructed according to the present invention.

Referring now to the drawings, the invention will now be described in more detail. As can best be seen in FIG. 1, a foldable, ready to use computer desk, designated generally as A, is illustrated which includes a desk top 10 having a top side 10*a* and an underneath side 10*b* (FIG. 2). A keyboard drawer assembly, designated generally as 12 is carried underneath the desk top 10 for containing a computer keyboard 14. The keyboard drawer assembly includes a pair of space support elements 16 and 18, as can best be seen in FIGS. 2 and 3. The spaced support elements support a slidable keyboard drawer 20, and extend away from the desk top to terminate at terminal edges 16*a* and 18*a* away from the desk top. First and second spaced desk side members 22 and 24 are pivotally carried by underneath surface 10*b* of desk top 10. The desk side members terminate in floor engaging supports 22*a* and 24*b* which engage the floor and support the desk top above the floor.

A plurality of hinges 30 and 32 having displaced pivots are attached to the underneath surface of the desk top and to the desk side members 24 and 22, respectively. Each displaced pivot hinge 30, 32 includes a first part 30*a*, 32*a* attached to underneath surface lob of the desk top, and a second hinge part 30*b*, 32*b* attached to a respective desk side member, as can best be seen in FIGS. 3 and 4. The first and second desk side members pivot about a respective pivot axis 30*c*, 32*c* of the pivot hinges between and extended position (FIGS. 1, 2, and 4) and a folded position (FIGS. 5A, 5B). In the folded position, first side member 22 is generally parallel to and overlying underneath 10*b* of desk top 10, and second side member 24 is generally parallel to and overlying first side member 22. For this purpose, pivot hinges 32 attaching second side member 24 to the desk top may have a longer leg 32*a* than hinges 30 affixing first side member 22 to the desk top, as can best be seen in FIGS. 5A and 5B. This displaces second side member 24 away from the table top a distance d2 greater than dl. Preferably d2 is four inches (4") and dl is three and one-fourth inches (3-¼"). A generally flat folded configuration may be had for the computer desk when in the folded position for convenient storage and shipment. In the folded position shown in FIGS. 5A and 5B, a utility space, designated generally as 36, is created which accommodates keyboard drawer assembly 12 and other utility parts of the computer desk such as a power strip 38, which may be a surge protector strip, and a cable tray 40, as can best be seen in FIGS. 2 and 3. Cable tray 40 supports the various cables 42 going to the computer equipment and the power sources and keeps them from dangling in an unsightly manner below the desk top. For this reason, cable tray 40 may be made to extend over the power surge strip and past the power surge strip a sufficient distance so that all the cables may be neatly tucked into the cable tray underneath the power strip in a generally concealed manner. A remote switch 43 is provided for turning the power, surge protector switch 38 off and on. For this purpose, switch 43 is affixed to the operator side of the desk. An optional opening may also be provided in the desk top for routing of monitor cords and the like.

Figure 1:
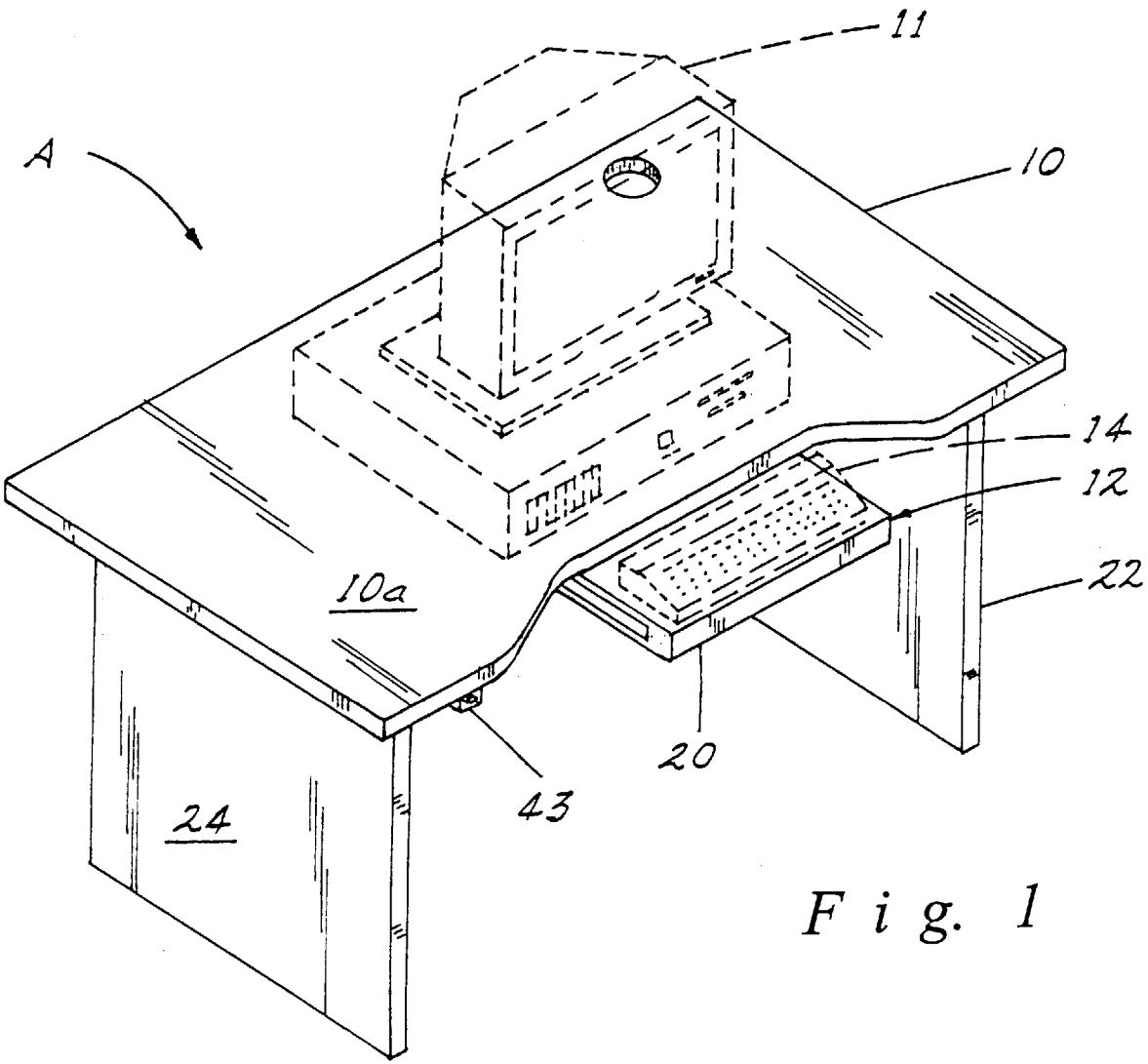
FIG. 1 is a perspective view of a ready to use computer desk constructed according to the present invention.
Figure 4:
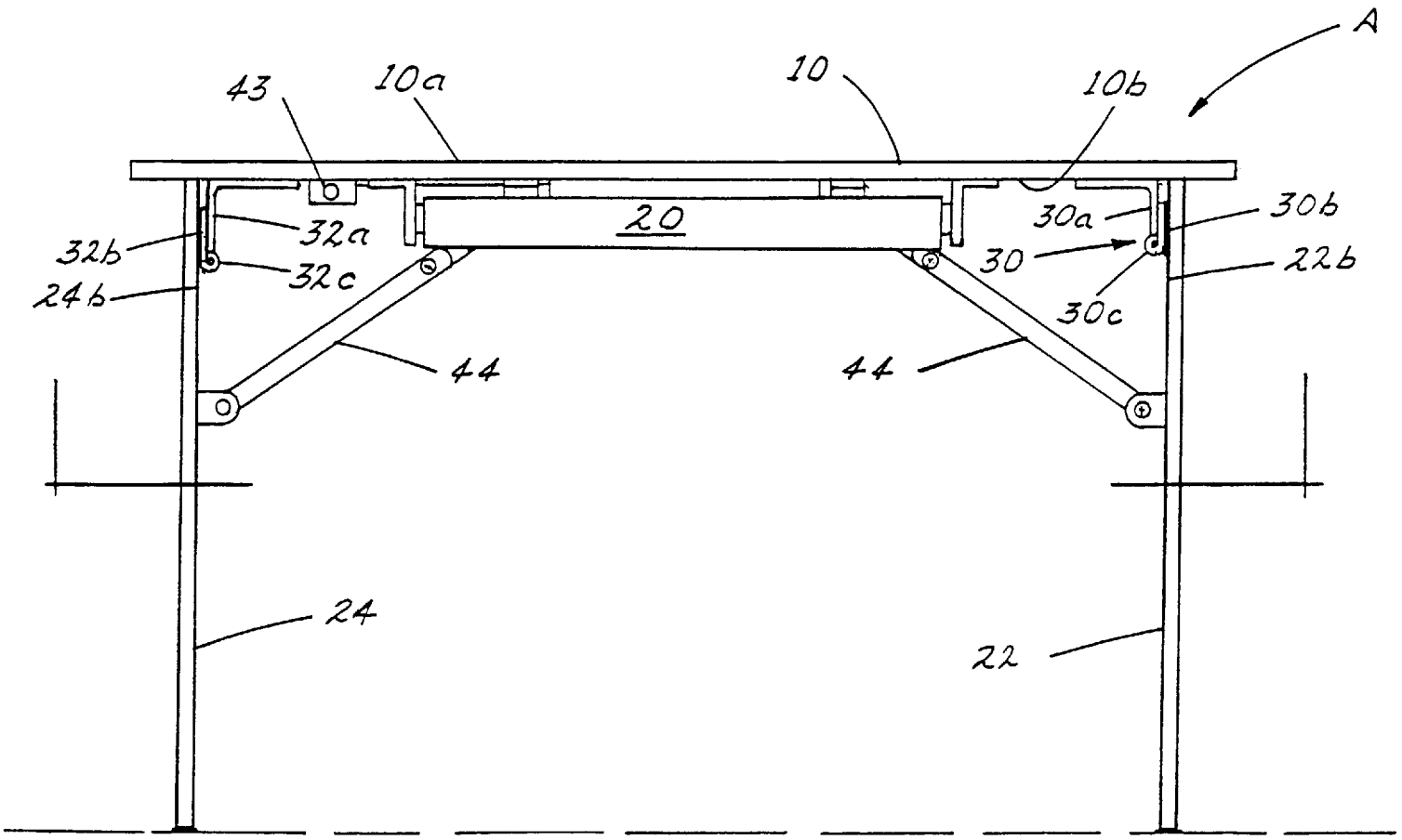
FIG. 4 is a front elevation illustrating a foldable, ready to use computer desk constructed according to the present invention in an upstanding ready to use configuration.
Figure 5A:
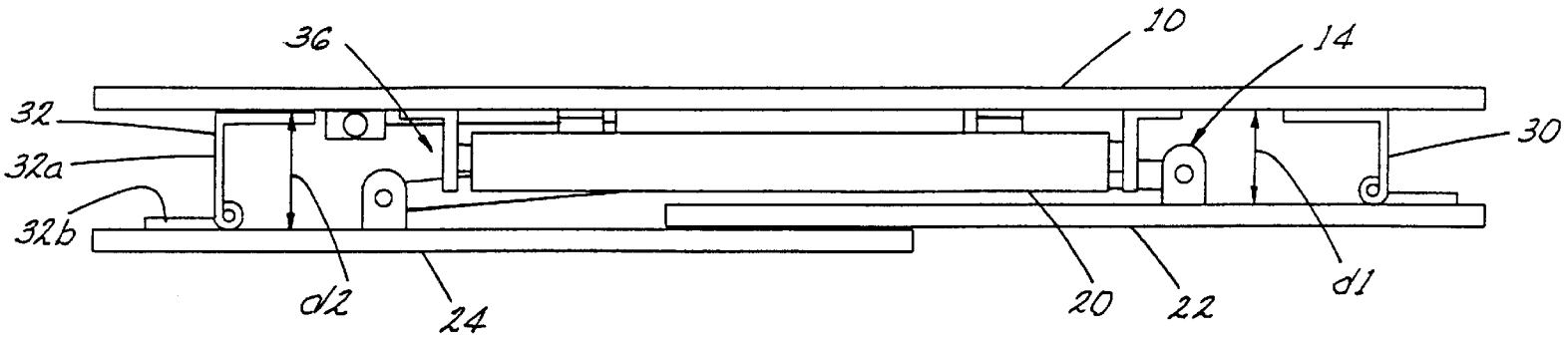
FIG. 5A is a front elevation of a foldable, ready to use computer desk constructed according to the present invention in a folded configuration.
Figure 5B:
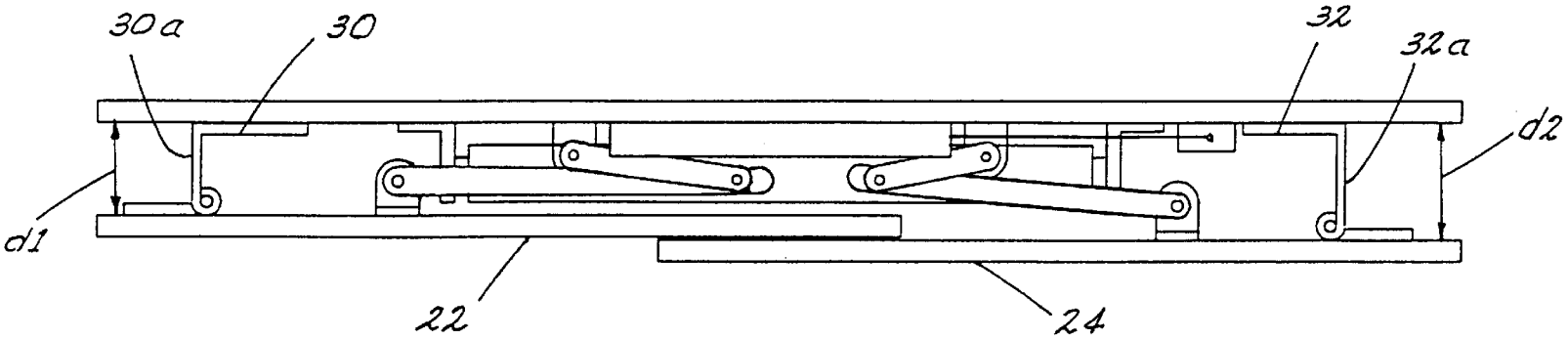
FIG. 5B is a rear view of the folded computer desk.
Figure 6:
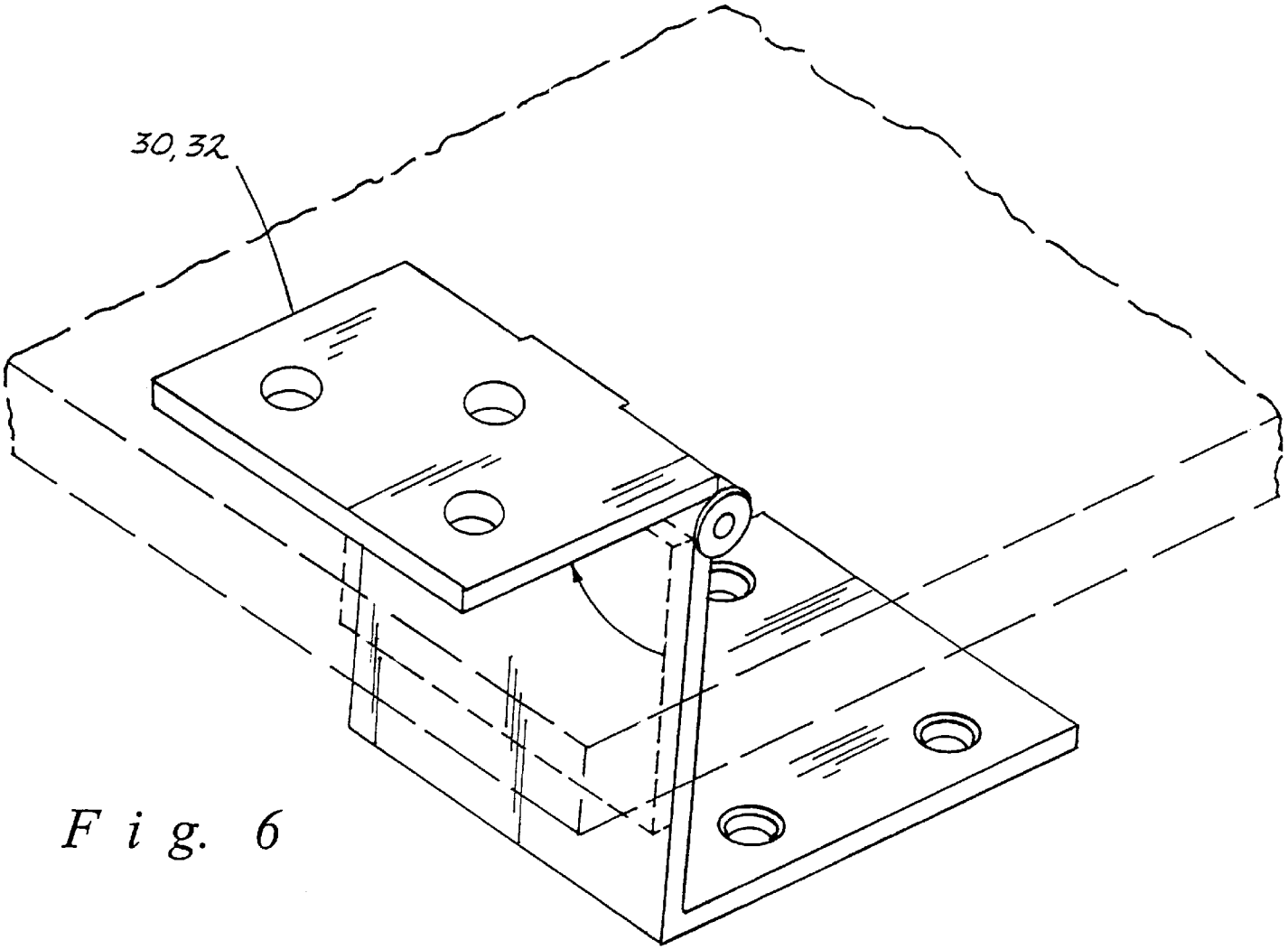
FIG. 6 is a perspective view of a hinge having a displaced pivot for use in connection with a foldable, ready to use computer desk constructed according to the present invention.
Figure 6A:
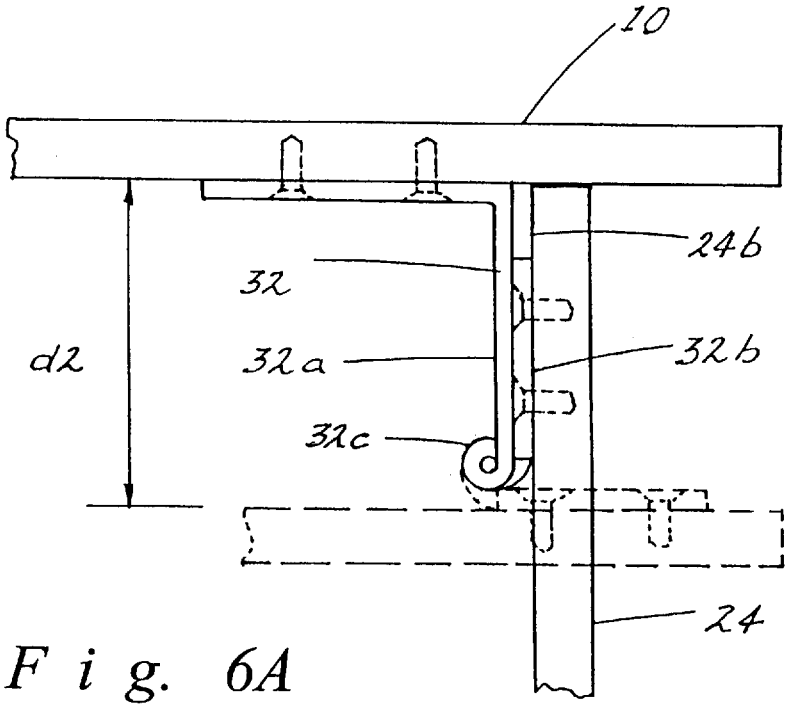
FIGS. 6A and 6B show partial front elevations of alternate displaced pivot hinges for a ready to use desk according to the invention.
Figure 6B:
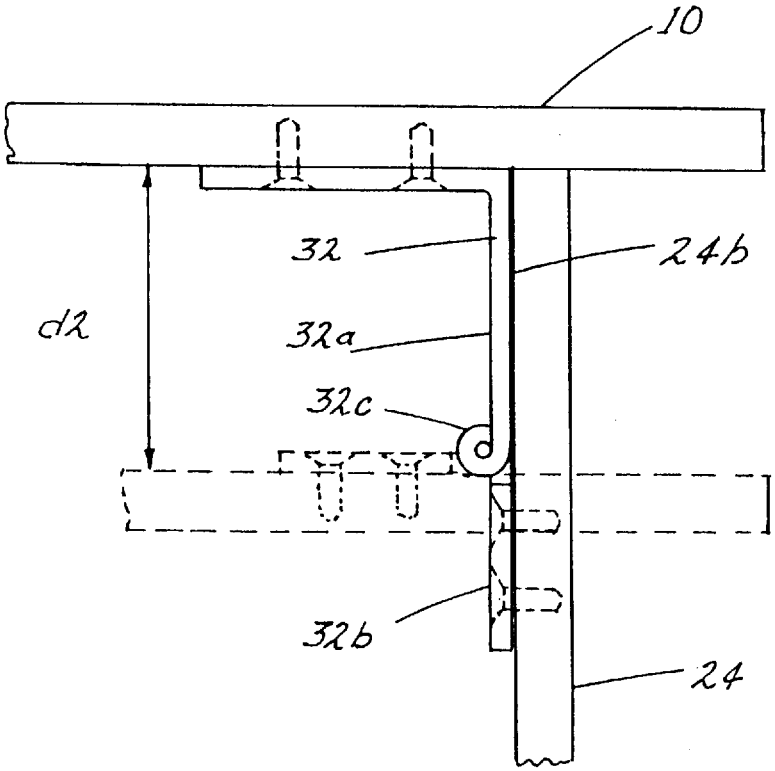

In the extended position, first and second desk side members 22, 24 are extended toward the floor and support the desk above the floor (FIG. 1, 4). As can best be seen in FIG. 4, in the extended position first side member 22 has an upper portion 22*b* which braces against leg 30*a* of each hinge 30. Second side member 24 likewise includes an upper portion 24*b* which is braced against leg 32*a* of hinges 32, as can best be seen in FIG. 6A and 6B showing two alternate forms of displaced pivot hinges.

A bracing assembly 44 is connected between desk top 10 and desk side members 22, 24 to urge the side members outwardly and tightly against hinge legs 30*a*, 32*a* to lock the desk sides in a rigid and sturdy extended position. While individual brace assemblies 44 are illustrated, a single brace may extend between the desk top and side members or between the side members themselves. Preferably, bracing elements 44 are self-locking so that when the side members are extended the braces are locked in a bracing position as shown in FIG. 4. Such bracing elements are commonly used on folding tables and the like. It has been found according to the present invention that the combination of the hinges with displaced pivots 30*c*, 32*c*, and upper engaging portions 22*b*, 24*b* of the desk side members, provides a highly sturdy desk configuration wherein the side members are braced and locked in a rigid position against the vertical hinge legs 30*a*, 32*a*.

Bracing assemblies 44 are secured to underneath 10*b* of the desk top by means of conventional screws 50. Likewise, the brace assemblies are secured to the legs by conventional screws or other means.

Advantageously, the top ends of the side members 22,24 may be constructed to lie flush with the ends of the desk top so the desk may be stood on its ends when folded for storage.

Figure 7:
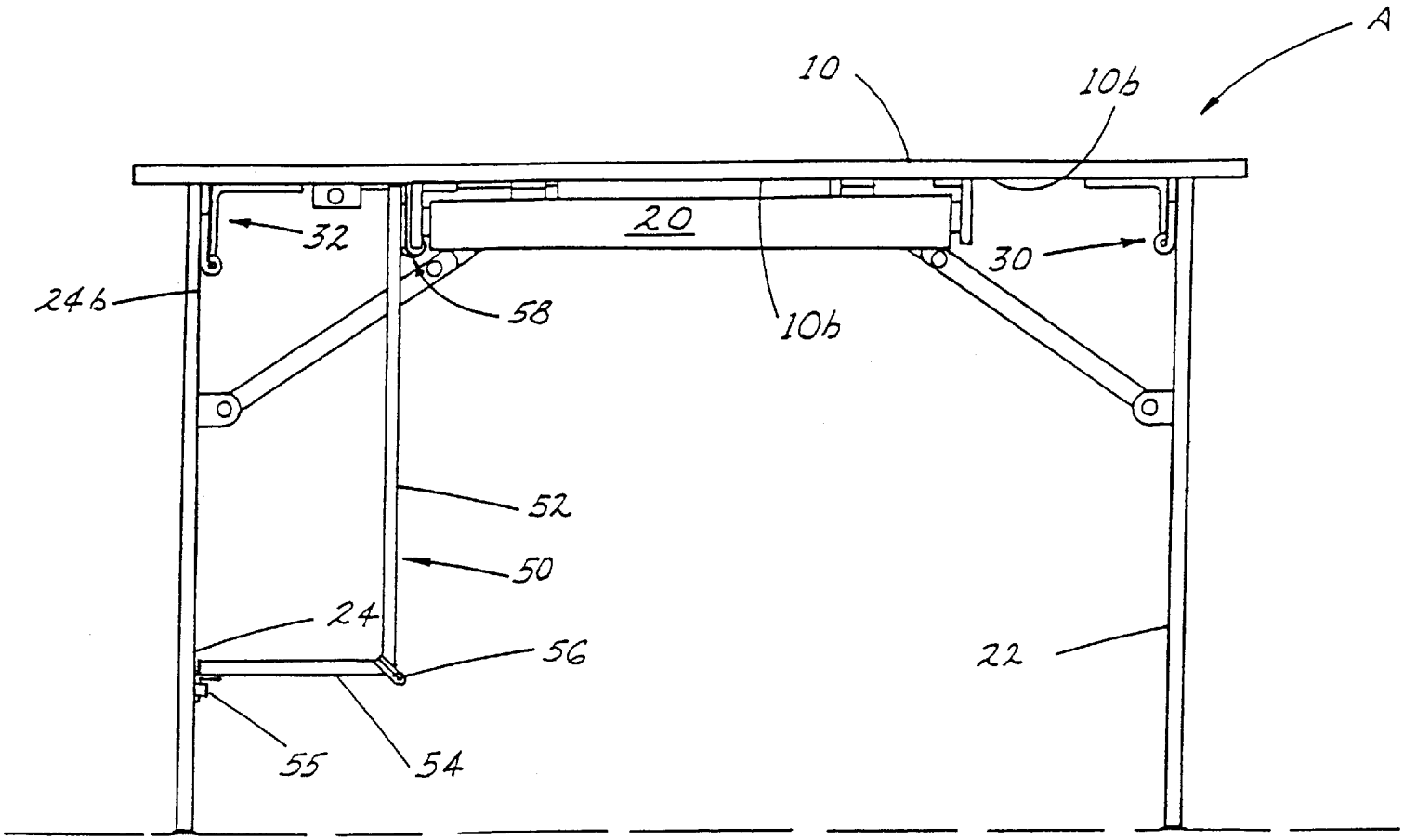
FIG. 7 is a front elevation illustrating another embodiment of a foldable, ready to use computer desk constructed according to the present invention in an upstanding, ready to use configuration including a tower shelf for supporting a computer processor unit.

In an alternate embodiment of the invention, a support shelf is added as illustrated in the front elevation view of FIG. 7. The support shelf 50 includes a horizontal section 54 providing a surface for supporting a tower unit of a computer. The horizontal section is supported at one edge by a clip and latch 55 attached to the inner surface 24*b* of the second side member 24. The computer table can also be designed with the support shelf supported by the first side member 22. The other edge of the horizontal shelf is supported by a vertical section 52 which is carried by a shelf pivot hinge 58 affixed to the underneath side 10*b* of the desk top 10 of the computer table A. The tower unit is protected from by the solid vertical section 52 from damage during use. A corner hinge 56 is used for attaching the horizontal section to the vertical section to allow the support shelf to be folded.

Figure 8:
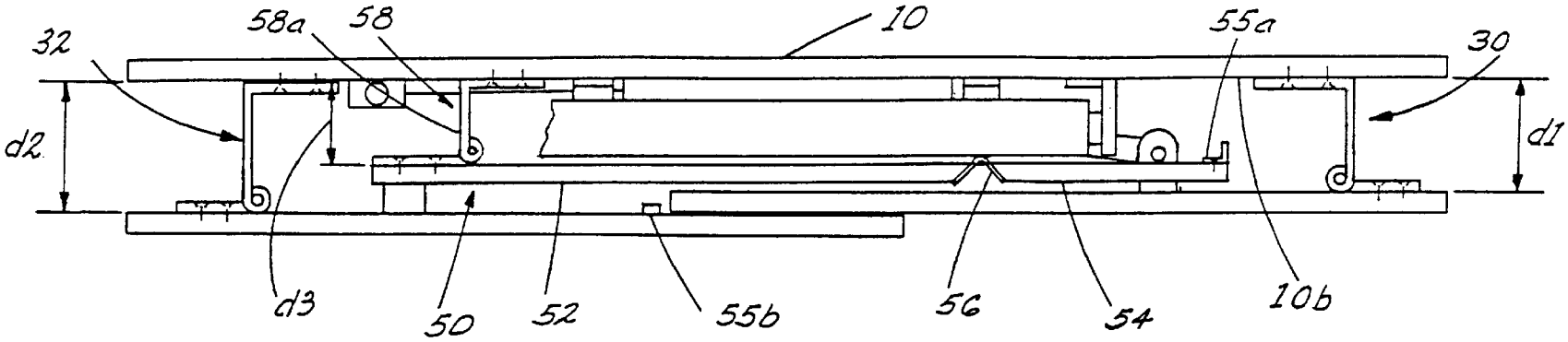
FIG. 8 is a front elevation of the embodiment of FIG. 7 in a folded configuration.
Figure 8A:
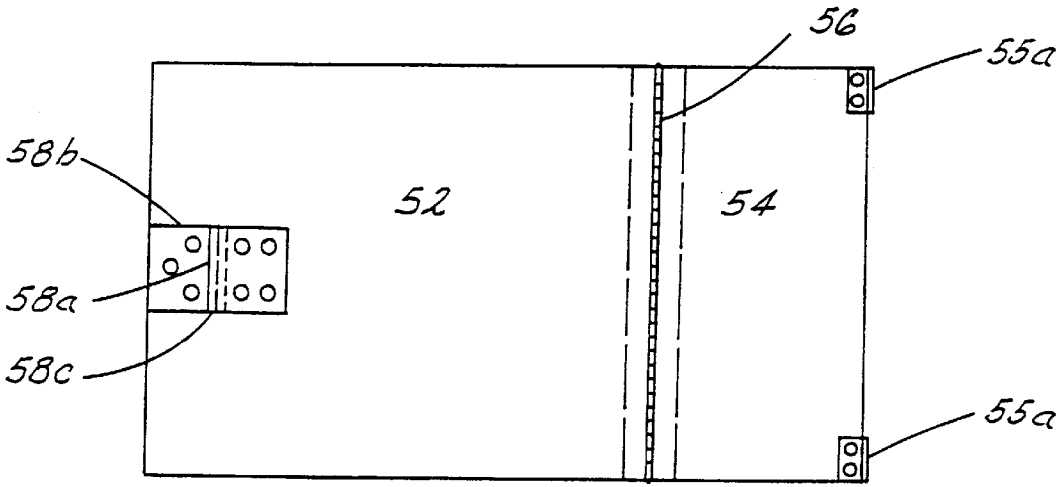
FIG. 8A is a plan view of the tower shelf within the folded computer desk.

The support shelf is designed to be folded along with the side members 22 and 24, as illustrated in FIGS. 8 and 8A. The shelf pivot hinge 58 has first and second pivot parts 58*a* and 58*b* and a displaced pivot 58*c* designed to operate the same as previously described for side member hinges 30 and 32 when folding the table. The vertical leg of the first part 58*a* of the shelf hinge has a length such that the folded support shelf 50 is a distance d3 from the underneath side 10*b* of the desk top 10 when folded. The distance dl provided by the vertical hinge leg of hinge 30 and distance d2 provided by the vertical hinge leg of hinge 32 must be increased to accommodate the support shelf of this alternate embodiment. The corner hinge 56 allows the horizontal and vertical sections of the support shelf to remain attached to one another but to pivot and be positioned in the same plane when the computer table is folded (FIG. 8A). The clip and latch has two parts being a clip portion 55*a* affixed to the horizontal section 54 and a peg portion 55*b* affixed to the side member 24. The clip and latch is decoupled to permit the support shelf to be folded.

While a preferred embodiment of the invention has been described using specific terms, such description is for illustrative purposes only, and it is to be understood that changes and variations may be made without departing from the spirit or scope of the following claims.

What is claimed is:

1. A foldable ready to use computer table comprising:

a desk top having a support surface for supporting computer equipment;

a keyboard drawer assembly for containing a computer keyboard carried underneath said desk top;

the keyboard drawer assembly having a pair of spaced support elements for supporting a slidable keyboard drawer, and said spaced support elements extending away from said desk top and terminating at terminal edges a predetermined distance away from said desk top;

first and second spaced desk side members pivotally carried by an underneath surface of said desk top, said first and second side members terminating in floor engaging supports for supporting said desk top above a floor;

displaced pivot hinges attaching said first and second side members to said underneath surface of said desk top, each of said displaced pivot hinges having a first part attached to said desk top, a second part attached to said side members, and a displaced pivot displaced from said first part and desk top about which said first and second side members pivot;

at least a first of said displaced pivot hinges attaching said first side member to said underneath surface of said desk top so that said first side member pivots about a first pivot axis displaced from said underneath surface between a folded position and an extended position;

said first side member being generally parallel to and overlying said desk top in said folded position and being extended away from said desk top to engage the floor to support said desk top and the computer equipment thereon in said extended position;

at least a second of said displaced pivot hinges attaching said second side member to said underneath surface of said desk top so that said second side member pivots about a second pivot axis displaced from said second side member between a folded position and an extended position;

said second side member being generally parallel to and overlying said first side member in said folded position and being extended away from said desk top to engage the floor to support said desk top and the computer equipment thereon in said extended position; and said first and second pivot axis being displaced from said underneath surface of said desk top so that said first and second side members fold over said terminal edges of said support elements of said keyboard drawer assembly in said folded position of said first and second side members in a compact, folded configuration for convenient storage and/or transportation.

2. The table of claim 1 wherein said first and second pivots of said hinges are displaced a distance past said terminal edges of said keyboard assembly.

3. The table of claim 1 including at least one brace member for maintaining said first and second side members in said extended position.

4. The table of claim 1 including a cable tray carried underneath said desk top, and an electrical connector carried in said cable tray for being electrically connected to said computer equipment so that electrical cords connecting said computer equipment may be stored in said cable tray generally out of sight.

5. The table of claim 1 wherein said second pivot axis of said second displacement hinge is displaced a greater distance from said desk top than said first pivot axis of said first displaced hinge.

6. The table of claim 1 wherein said first and second side members include a bracing portion which abuts a vertical leg of a respective displacement hinge in said extended position, and including at least one brace assembly for urging the bracing portions of said first and second side elements against said vertical legs in said extended position.

7. The table of claim 1 including a support shelf carried by said desk top which includes a horizontal section for supporting a computer unit, a vertical section for supporting said horizontal section, and at least one of said horizontal and vertical sections being foldable realative to the other so that said support shelf may be folded inside said first and second side members when in said folded position.

8. The table of claim 7 including a releasable attachment for attaching at least one of said horizontal and vertical sections to one of said side members and said desk top respectively, and a support shelf hingle for attaching the other of said sections to said desk in said unfolded position.

9. A foldable, ready to use computer desk comprising:

a desk top;

a first foldable desk side member carried by a first side of said desk top, and a second foldable desk side member carried by a second side of said desk top;

at least a first hinge pivotally affixing said first side member to said desk top, said first hinge having a pivot axis displaced a distance from said desk top;

at least a second hinge pivotally affixing said second side member to said desk top, said second hinge having a pivot axis displaced a distance from said desk top;

said first side member having a folded position in which said first side member assumes a generally parallel overlying relation to said desk top, and said second side member having a folded position in which said second side member assumes a generally parallel overlying configuration with respect to said first side member;

a utility space defined between said first and second side members in said folded positions and an underneath surface of said desk top; and at least one utility device carried within said utility space for use with computer equipment which includes at least a keyboard drawer assembly secured underneath said desk top which is nested between said underneath surface of said desk top and said side members and said folded positions.

10. The desk of claim 9 wherein said pivot axis of said second side member is displaced a first distance which is greater than a second distance which is the distance of displacement of said pivot axis of said first side member.

11. The desk of claim 9 including at least one brace member for maintaining said first and second side members in said extended positions.

12. The desk of claim 9 including a cable tray carried underneath said desk top for housing cables of said equipment supported on said desk.

13. The desk of claim 12 including an electrical connector carried underneath said desk top near said cable tray for being electrically connected to said computer equipment so that electrical cords connecting said computer equipment may be stored in said cable tray generally out of sight.

14. The desk of claim 9 wherein said first and second side members comprise solid side panels.

15. The desk of claim 14 wherein said side members include top ends which lie flush with the ends of said desk top in said folded configuration so that said folded desk my be stood on said ends for storage.

16. The desk of claim 9 including a foldable support shelf having a horizontal support section releasably carried by one of said side members and a vertical side section carried by said desk top.

17. The desk of claim 16 wherein said horizontal section is pivotally attached to said vertical section by a corner hinge, and including a support hinge pivotally affixing said vertical section to said desk top, said support shelf having a folded position in which said horizontal and vertical sections assume a generally parallel overlying relation between said first side member and said desk top.

18. The desk of claim 17 wherein said shelf hinge has a pivot axis for displacing said horizontal and vertical sections a third distances from said desk top, said third distance being less than said first distance.

19. The table of claim 1 wherein said first and second sides are solid providing an elongated floor engaging supports.

20. A foldable, ready to use computer desk comprising:

a desk top;

a first foldable desk side member carried by a first side of said desk top, and a second foldable desk side member carried by a second side of said desk top;

at least a first hinge pivotally affixing said first side member to said desk top;

at least a second hinge pivotally affixing said second side member to said desk top;

said first side member having a folded position in which said first side member assumes a generally overlying configuration with respect to said desk top, and said second side member having a folded position in which said second side member assumes a generally overlying configuration with respect to said first side member;

a utility space defined between said first and second side members in said folded positions and an underneath surface of said desk top; and at least one utility device carried within said utility space for use with computer equipment and the like including a support shelf carried by said desk top which includes a horizontal section for supporting a computer unit, a vertical section for supporting said horizontal section, and said horizontal and vertical sections being foldable realative to each other so that said support shelf may be folded with said first and second side members when in said folded position.

21. The desk of claim 20 including a releasable attachment for attaching at least one of said horizontal and vertical sections to one of said side members and said desk top respectively, and a support shelf hinge for attaching the other of said sections to said desk in said unfolded position.

22. The desk of claim 21 including a keyboard drawer assembly secured underneath said desk top which is nested between said underneath surface of said desk top and said side members in said folded positions.

* * * * *